US007256361B1

(12) United States Patent
Lee

(10) Patent No.: US 7,256,361 B1
(45) Date of Patent: Aug. 14, 2007

(54) PRESSURE SWITCH

(76) Inventor: Su-Yun Lee, No. 49-12, Wannian Lane, Yuanlin Town, Changhua County 510 (TW)

( * ) Notice: Subject to any disclaimer, the term of this patent is extended or adjusted under 35 U.S.C. 154(b) by 0 days.

(21) Appl. No.: 11/616,354

(22) Filed: Dec. 27, 2006

(51) Int. Cl.
*H01H 35/34* (2006.01)

(52) U.S. Cl. ..... 200/83 R; 200/83 J; 200/83 P; 200/83 S; 200/83 SA

(58) Field of Classification Search ..... 200/83 R, 200/83 A, 83 B, 83 D, 83 J, 83 P, 83 Q, 200/83 S, 83 SA, 83 Y
See application file for complete search history.

(56) References Cited

U.S. PATENT DOCUMENTS 4,194,103 A * 3/1980 Smith ..... 200/456
4,220,836 A * 9/1980 Hersey ..... 200/83 P
4,524,255 A * 6/1985 Haag ..... 200/83 R
4,939,321 A * 7/1990 Tanaka et al. ..... 200/83 P
4,998,087 A * 3/1991 Boulanger ..... 337/354
5,198,631 A * 3/1993 Hogue et al. ..... 200/83 P
5,308,939 A * 5/1994 Sasaki ..... 200/83 R
5,672,049 A * 9/1997 Ciurlo ..... 417/44.1
5,814,779 A * 9/1998 Verras et al. ..... 200/83 P
5,932,857 A * 8/1999 Stander et al. ..... 200/83 B
6,329,619 B1 * 12/2001 Koguchi ..... 200/83 J
6,525,286 B2 * 2/2003 Koguchi et al. ..... 200/83 Y

* cited by examiner

*Primary Examiner*—Michael A Friedhofer
(74) *Attorney, Agent, or Firm*—Ming Chow; Sinorica, LLC

(57) ABSTRACT

A pressure switch includes a body, a lower cap and an upper cap respectively mounted to two opposite ends of the body. A casing is airtightly sleeved on an outer periphery of each of the lower cap and the upper cap. There are two electrodes disposed in the body and selectively electrically contacted with each other. A micro-adjust set is disposed in the body to adjust a distance between the two electrodes for preventing the pressure switch from an interior bad contact when the pressure switch is used for a period of time.

5 Claims, 10 Drawing Sheets

PRESSURE SWITCH

BACKGROUND OF THE INVENTION

1. Field of the Invention

The present invention relates to a pressure switch, and more particularly to a pressure switch that has a micro-adjust function for preventing the pressure switch from an interior bad contact.

2. Description of Related Art

A conventional pressure switch in accordance with the prior art shown in FIG. 10 comprises body (50), an upper cap (51) and a lower cap (53) respectively mounted to two opposite ends of the body (50). A casing (52) is airtightly sleeved on an outer periphery of each of the lower cap (53) and the upper cap (51). A pressure receiver (500) is disposed in a top portion of the body (50). A seat (530) is mounted on the lower cap (53). An L-shaped elastic plate (501) and an electrode (502) respectively and electrically connected to the seat (530). The elastic plate (501) is urged a lower end of the pressure receiver (500) and selectively electrically connected to the electrode (502). An inlet (510) is defined in the upper cap (51) and communicates with an inner periphery of the body (50).

The pressure receiver (500) pushes the elastic plate (501) to contact with the electrode (502) for forming a closed circuit when fluid flows into the body (50) through the inlet (510) and the pressure receiver (500) senses a pressure. However, the elastic plate (501) may cause an elastic fatique condition after being used for a period of time. As a result, a bad contact may be caused between the elastic plate (501) and the electrode (502).

The present invention has arisen to mitigate and/or obviate the disadvantages of the conventional pressure switch.

SUMMARY OF THE INVENTION

The main objective of the present invention is to provide an improved pressure switch that has a micro-adjust function for preventing the pressure switch from an interior bad contact.

To achieve the objective, the pressure switch in accordance with the present invention comprises a body, a lower cap and an upper cap respectively mounted to two opposite ends of the body. A casing is airtightly sleeved on an outer periphery of each of the lower cap and the upper cap. There are two electrodes disposed in the body and selectively electrically contacted with each other. A micro-adjust set is disposed in the body to adjust a distance between the two electrodes for preventing the pressure switch from an interior bad contact when the pressure switch is used for a period of time.

Further benefits and advantages of the present invention will become apparent after a careful reading of the detailed description with appropriate reference to the accompanying drawings.

DETAILED DESCRIPTION OF THE INVENTION

Figure 1:
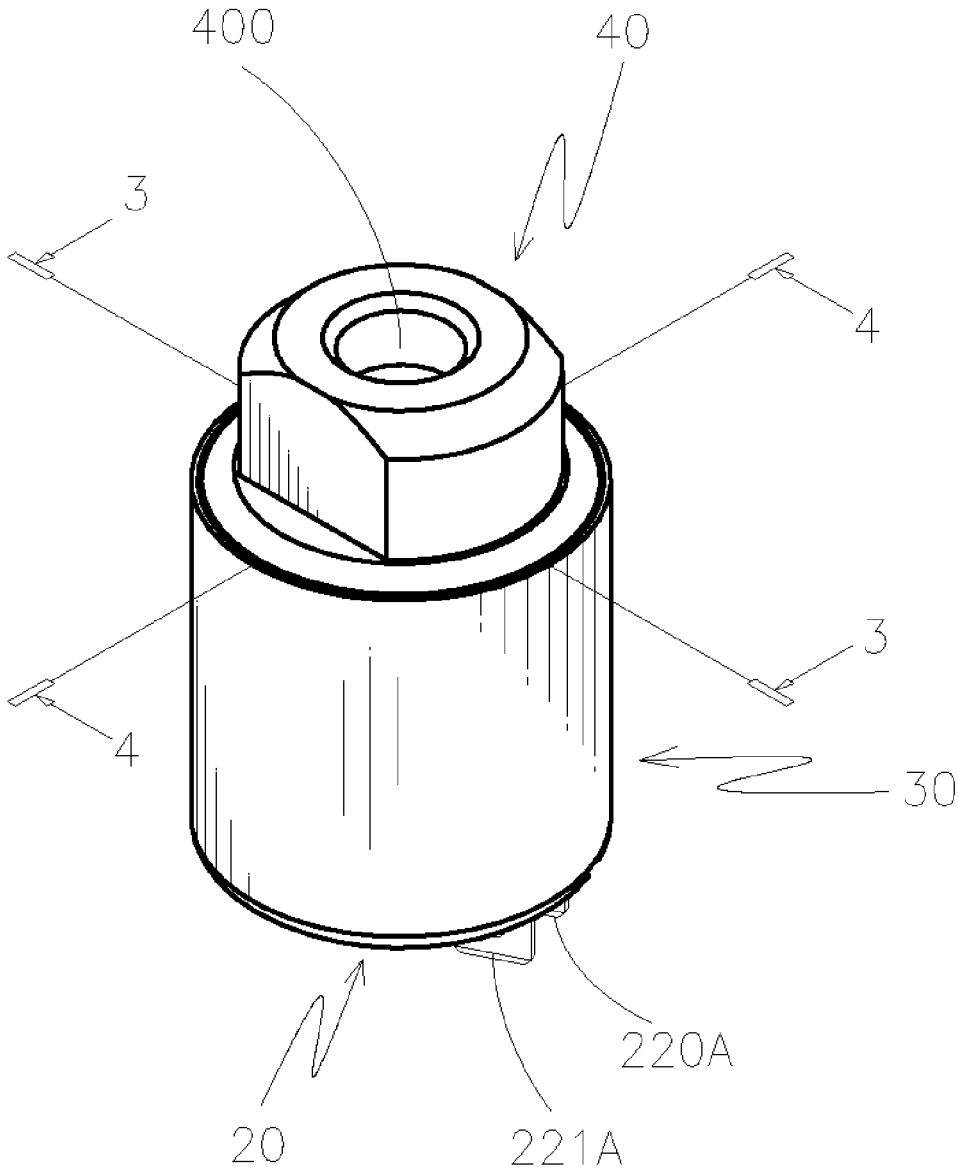
FIG. 1 is a perspective view of a pressure switch in accordance with the present invention.
Figure 2:
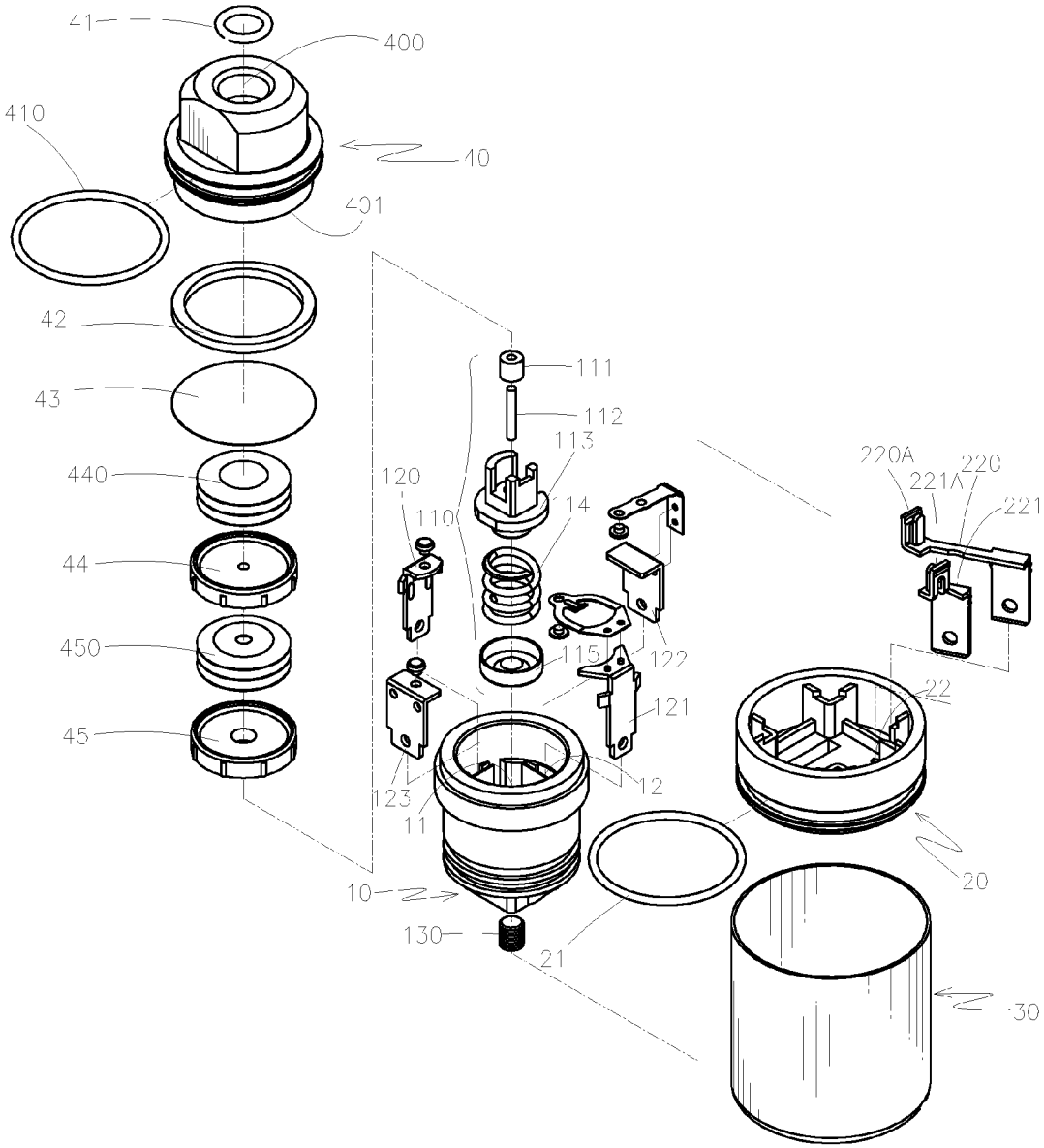
FIG. 2 is an exploded perspective view of the pressure switch in FIG. 1.
Figure 3:
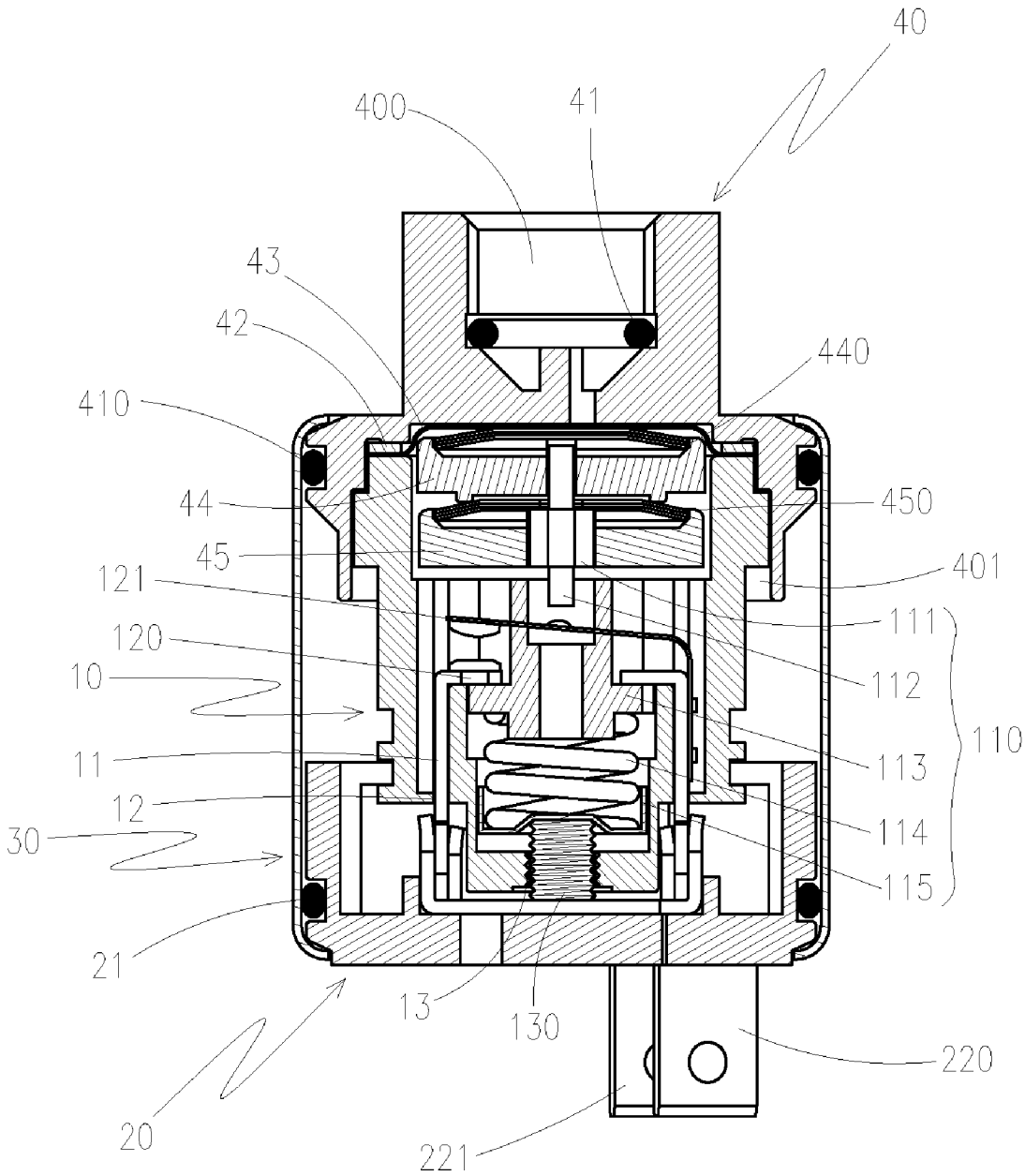
FIG. 3 is a cross-sectional view of the pressure switch in FIG. 1 along line 3-3.
Figure 4:
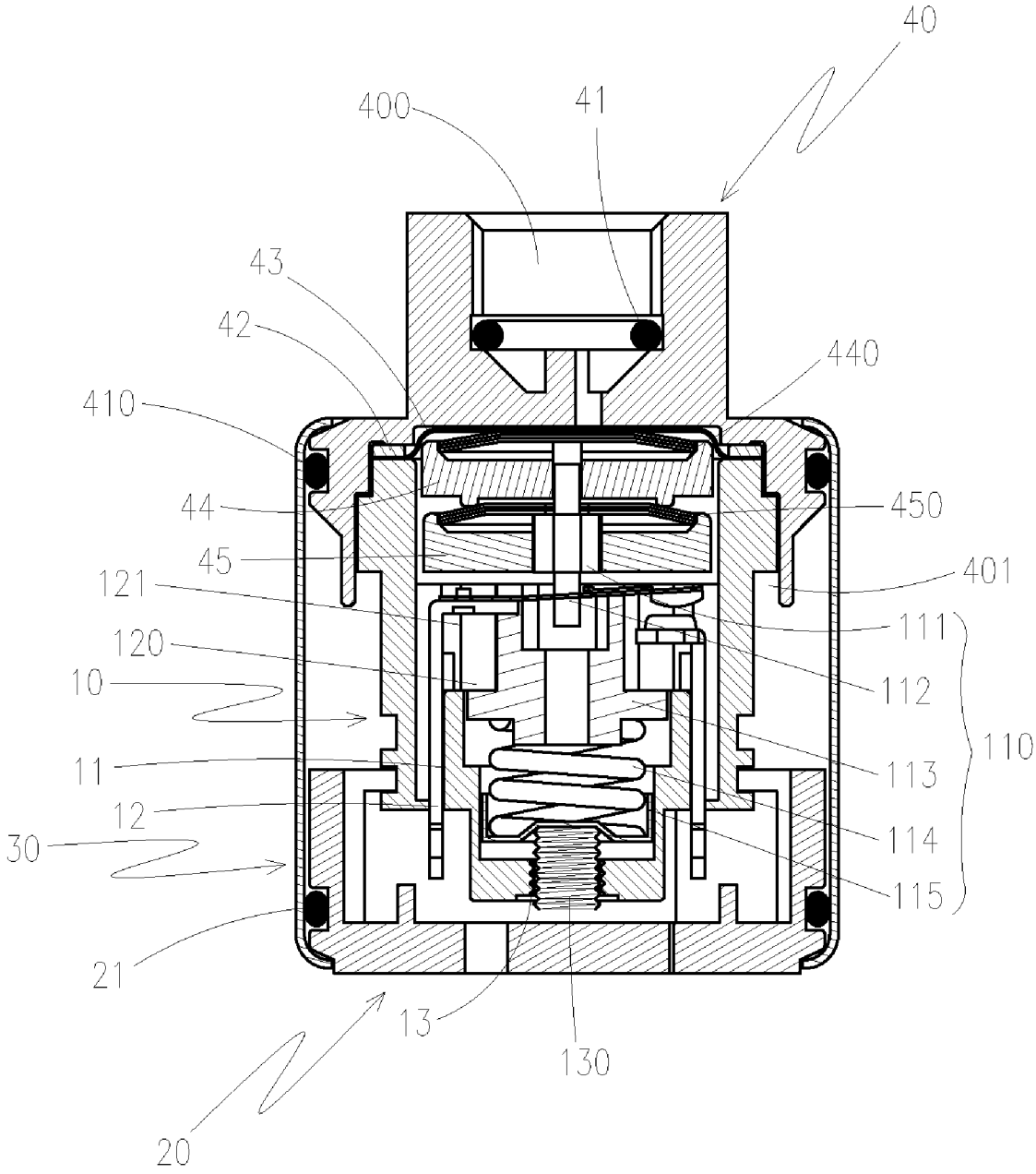
FIG. 4 is a cross-sectional view of the pressure switch in FIG. 1 along line 4-4.

Referring to the drawings and initially to FIGS. 1-4, a pressure switch in accordance with the present invention comprises a body (10) a lower cap (20) and an upper cap (40) respectively mounted to two opposite ends of the body (10). A casing (30) is airtightly sleeved on an outer periphery of each of the lower cap (20) and the upper cap (40).

The body (10) has a receiving space (11) defined therein and formed with a close end and an open end. Four passages (12) are respectively and longitudinally defined in a periphery of the receiving space (11), and a threaded hole (13) defined in the close end of the body (10) and communicating with the receiving space (11). A micro-adjust set (110) is received in the receiving space (11). The micro-adjust set (110) includes a cap (115) urged the close end of the body (10) and corresponding to the threaded hole (130). A resilient member (114), an adjust seat (113), a insulate stick (112) and an insulator (111) sequentially disposed on the cap (115), wherein the resilient member (114) is compressively mounted between the cap (115) and the adjust seat (13) and the insulator (111) is sleeved on the insulate stick (112). A first lead (120), a second lead (121), a third lead (122) and a fourth lead (123) are respectively inserted into a corresponding one of the four passages (12). A bolt (130) is screwed through the threaded hole (13) to abut against a bottom of the cap (115).

The lower cap (20) has two passages (22) longitudinally defined therein. A first prong (220) and a second prong (221) respectively extend through a corresponding one of the two passages (22) in the lower cap (20) and are electrically connected to the first lead (120) and the second lead (121). The first prong (220) and the second prong (221) respectively have a clamp (220A, 221A) formed on one end thereof for clamping the first lead (120) and the second lead (121). A first O-ring (21) is mounted around the lower cap (20) for securely abutting against an inner periphery of the casing (30) to achieve an airtight effect.

The upper cap (40) includes an inlet (400) defined therein and extending therethrough. A second O-ring (41) is disposed in an inner periphery of the inlet (400) and a third O-ring (410) is mounted around the upper cap (40) for securely abutting against the inner periphery of the casing (30) to achieve an airtight effect. A free space (401) is defined in the upper cap (40) for sequentially receiving a washer (42), a diaphragm (43), a first seat (44) and a second seat (45). A first resilient film (440) and a second resilient film (450) are respectively disposed in the first seat (44) and the second seat (45). The diaphragm (43) selectively closes the inlet (400). The insulator (111) is movably received in the second seat (45). The insulate stick (111) sequentially extends through second seat (45), the second resilient film (450) and the first seat (44) and abuts against the first resilient film (440).

Figure 5:
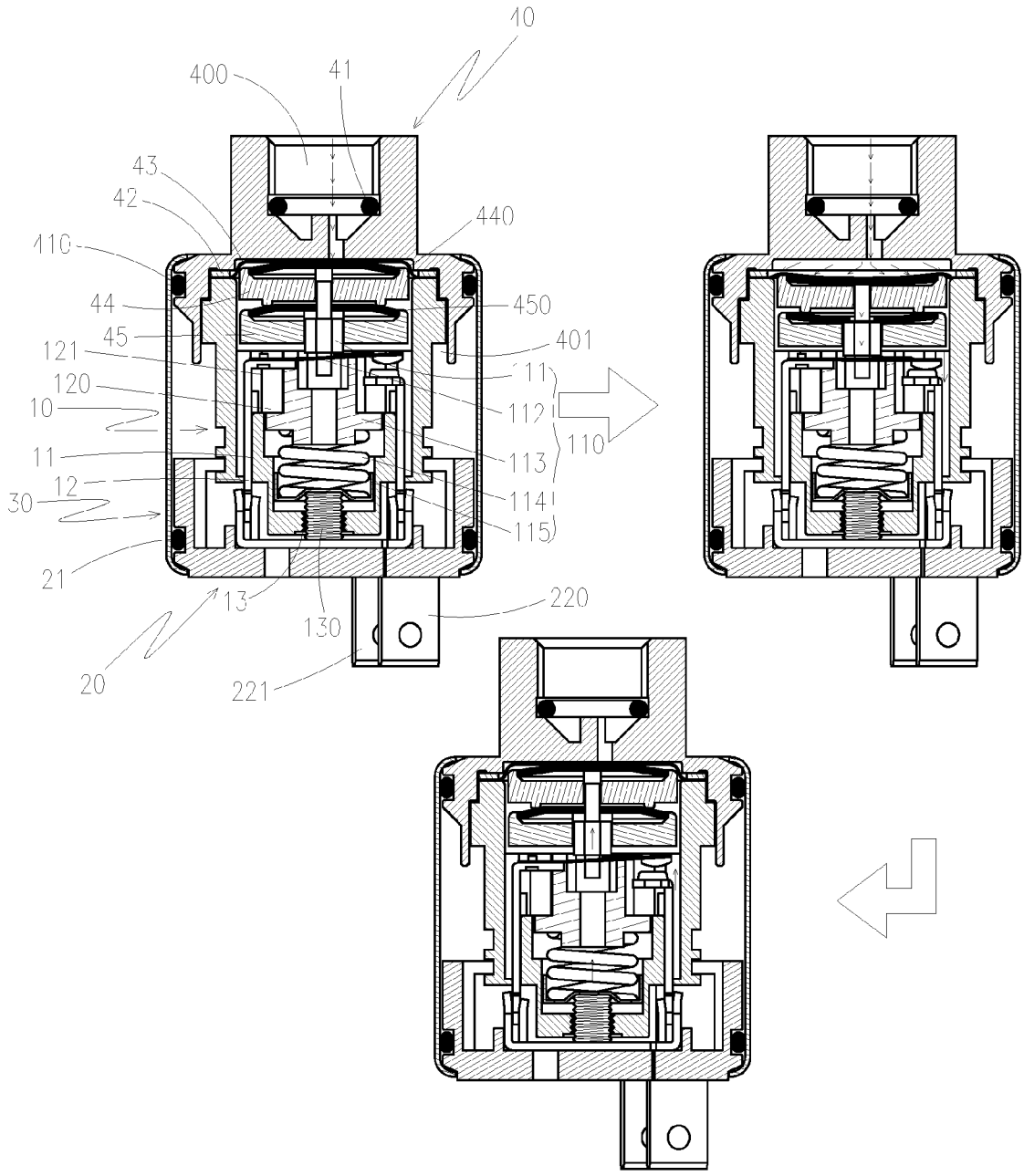
FIG. 5 is an operational flow chart of the pressure switch of the present invention when being actuated.

With reference to FIG. 5, the diaphragm (43) is deformed toward the micro-adjust set (110) when fluid flows into the inlet (400) and forms a pressure, thereby pushing the first resilient film (440) and the second resilient film (450) for driving the insulate stick (111) with the insulator (112) moved toward the body (10). As a result, the second lead (121) is pressed to electrically contact with the first lead (120). In addition, the third lead (122) and the fourth lead (123) can prevent the micro-adjust set (110) from a laterally movement when the micro-adjust set (110) is longitudinally moved relative to the body (10).

Figure 6:
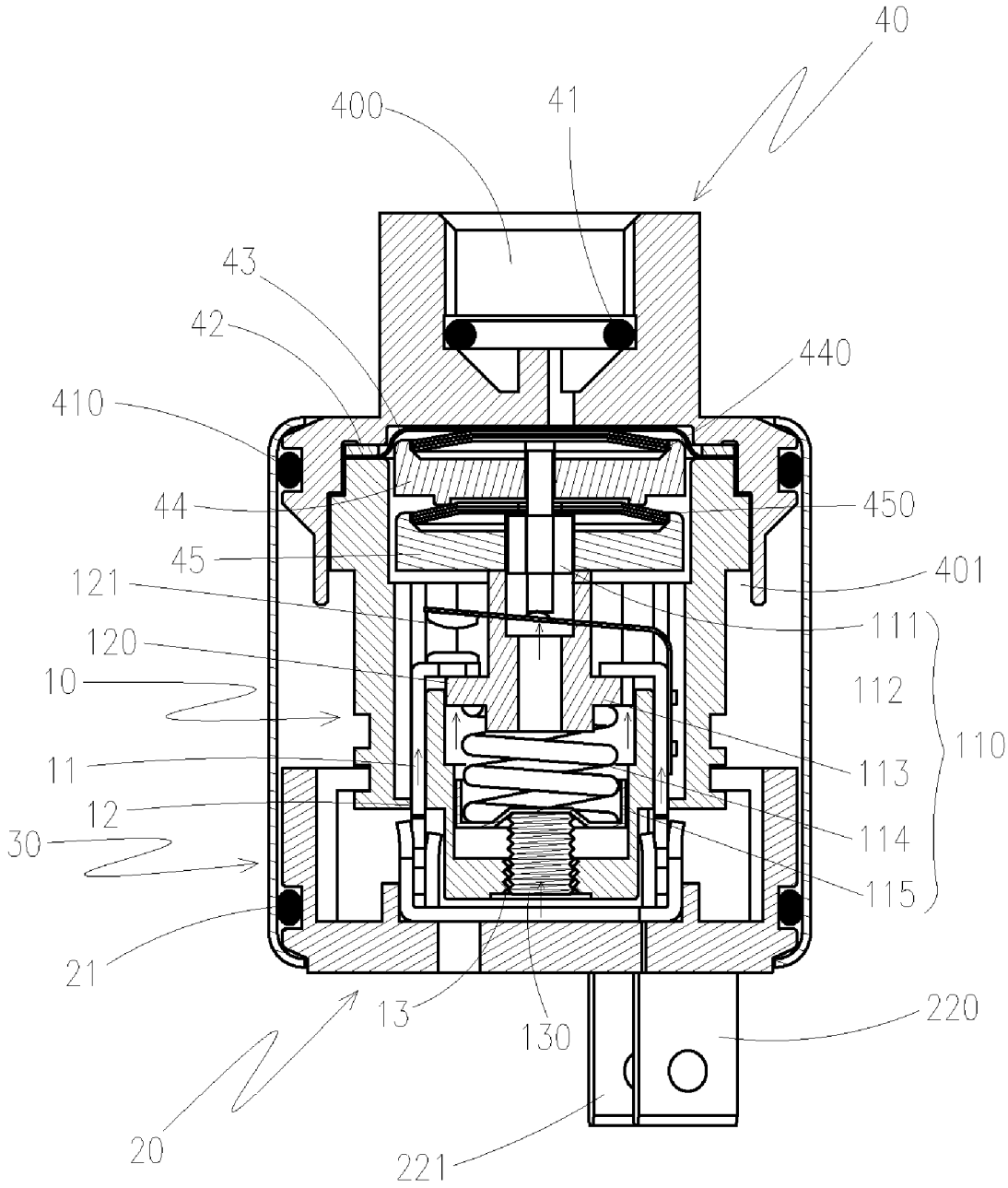
FIG. 6 is a cross-sectional view of the pressure switch of the present invention when being adjusted.

With reference to FIG. 6, the micro-adjust set (110) is moved toward the upper cap (40) to shorten a distance between the first lead (120) and the second lead (121) when the bolt (130) is screwed into the body (10). As a result, a shortened distance between the first lead (120) and the second lead (121) can prevent the pressure switch from an interior bad contact when the first lead (120) and the second lead (121) are used for a period of time.

Figure 7:
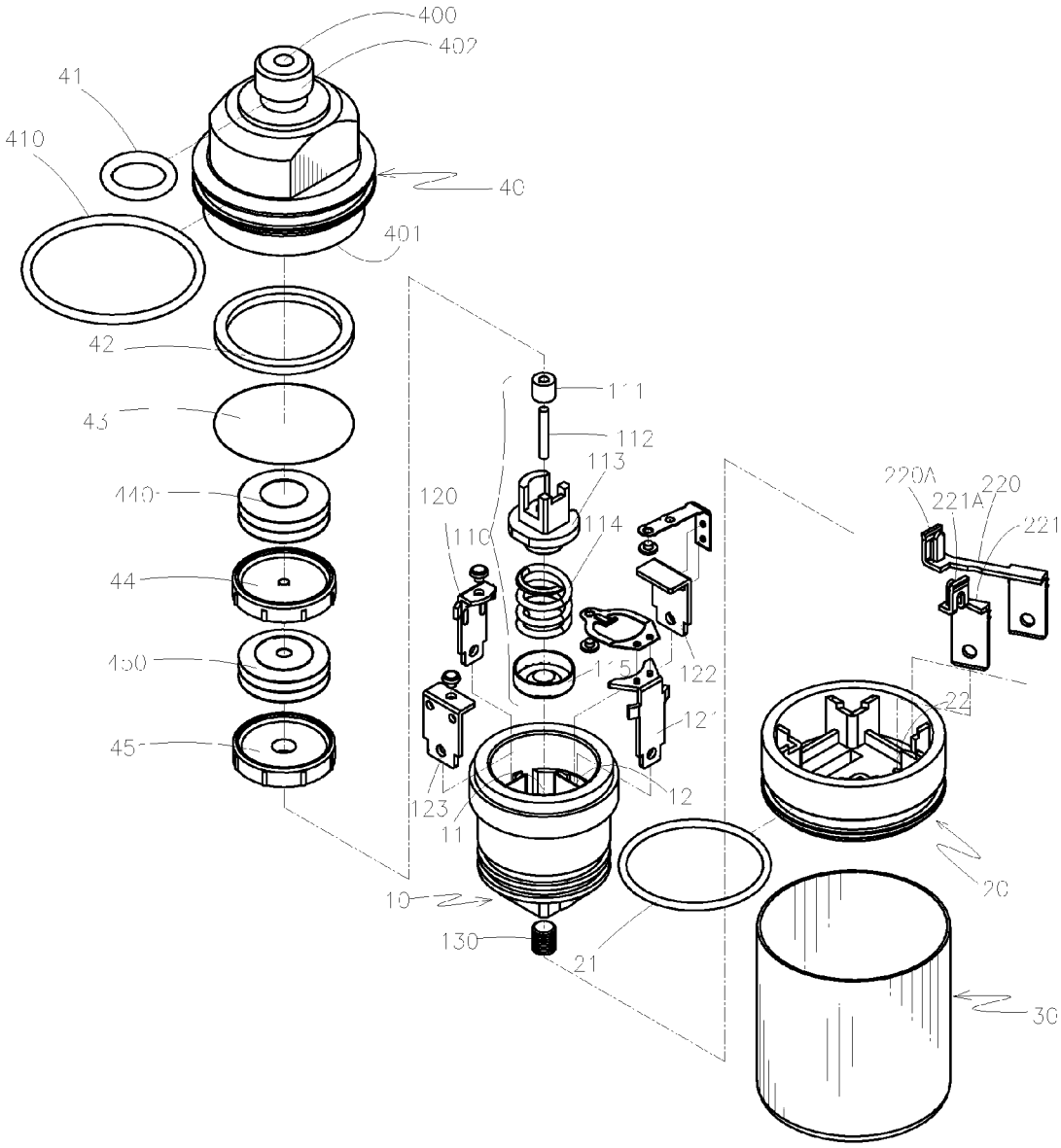
FIG. 7 is an exploded perspective view of a second embodiment of the pressure switch in accordance with the present invention.

With reference to FIG. 7 that shows a second embodiment of the pressure switch in accordance with the present invention, in this embodiment, the upper cap (40) further includes a connector (402) longitudinally extending therefrom for corresponding with different assemble ways.

Figure 8:
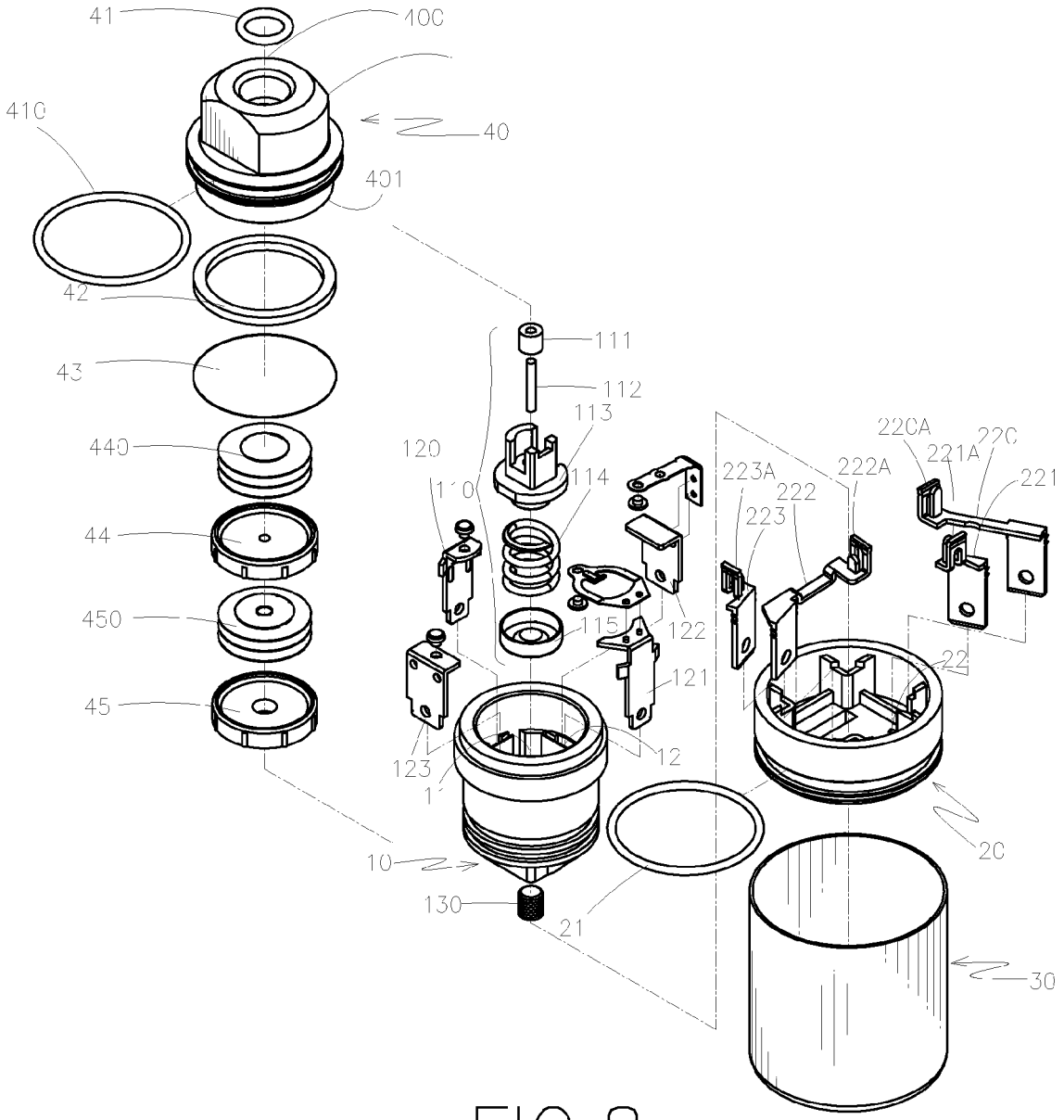
FIG. 8 is an exploded perspective view of a third embodiment of the pressure switch in accordance with the present invention.
Figure 9:
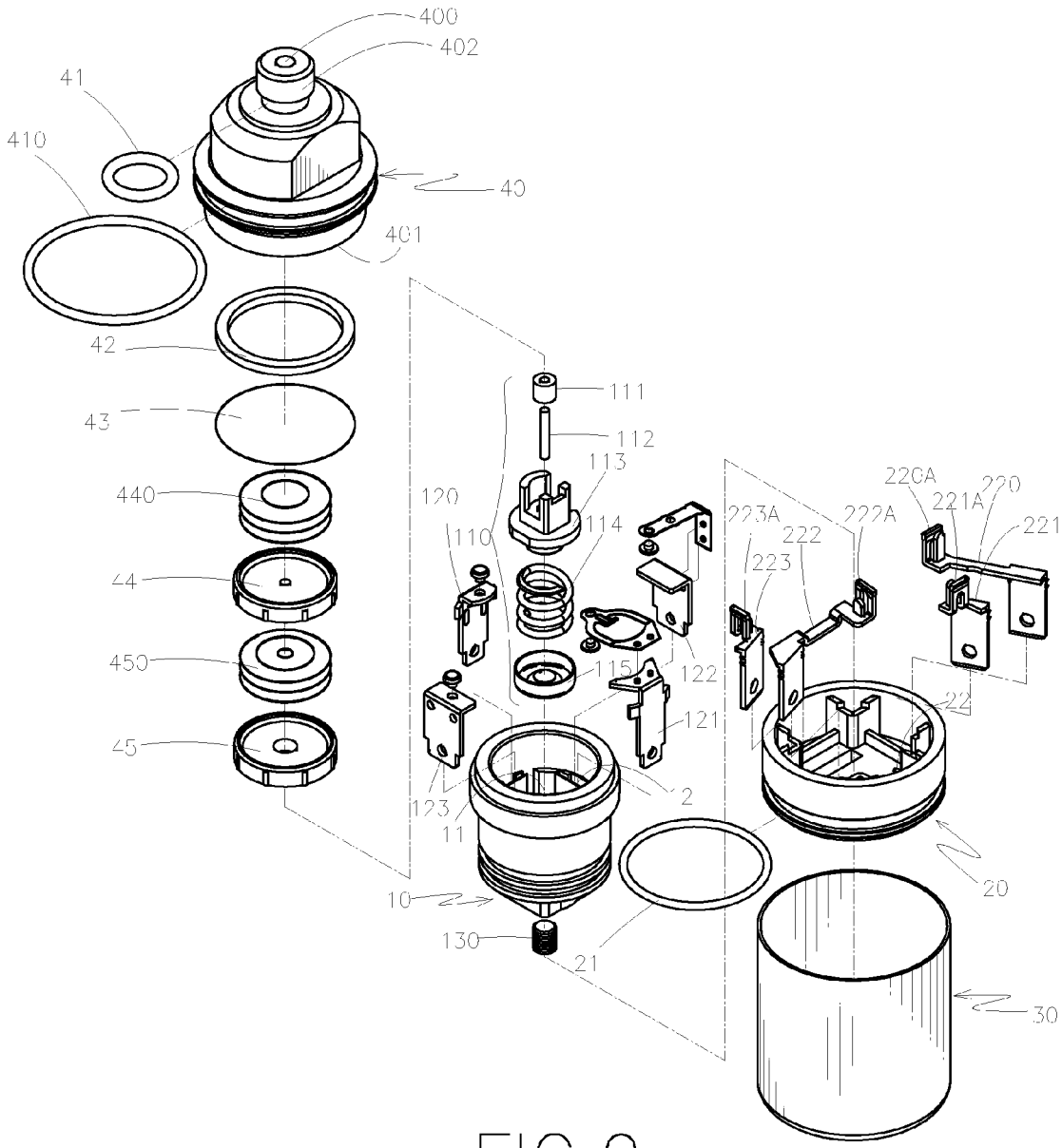
FIG. 9 is an exploded perspective view of a fourth embodiment of the pressure switch in accordance with the present invention.
Figure 10:
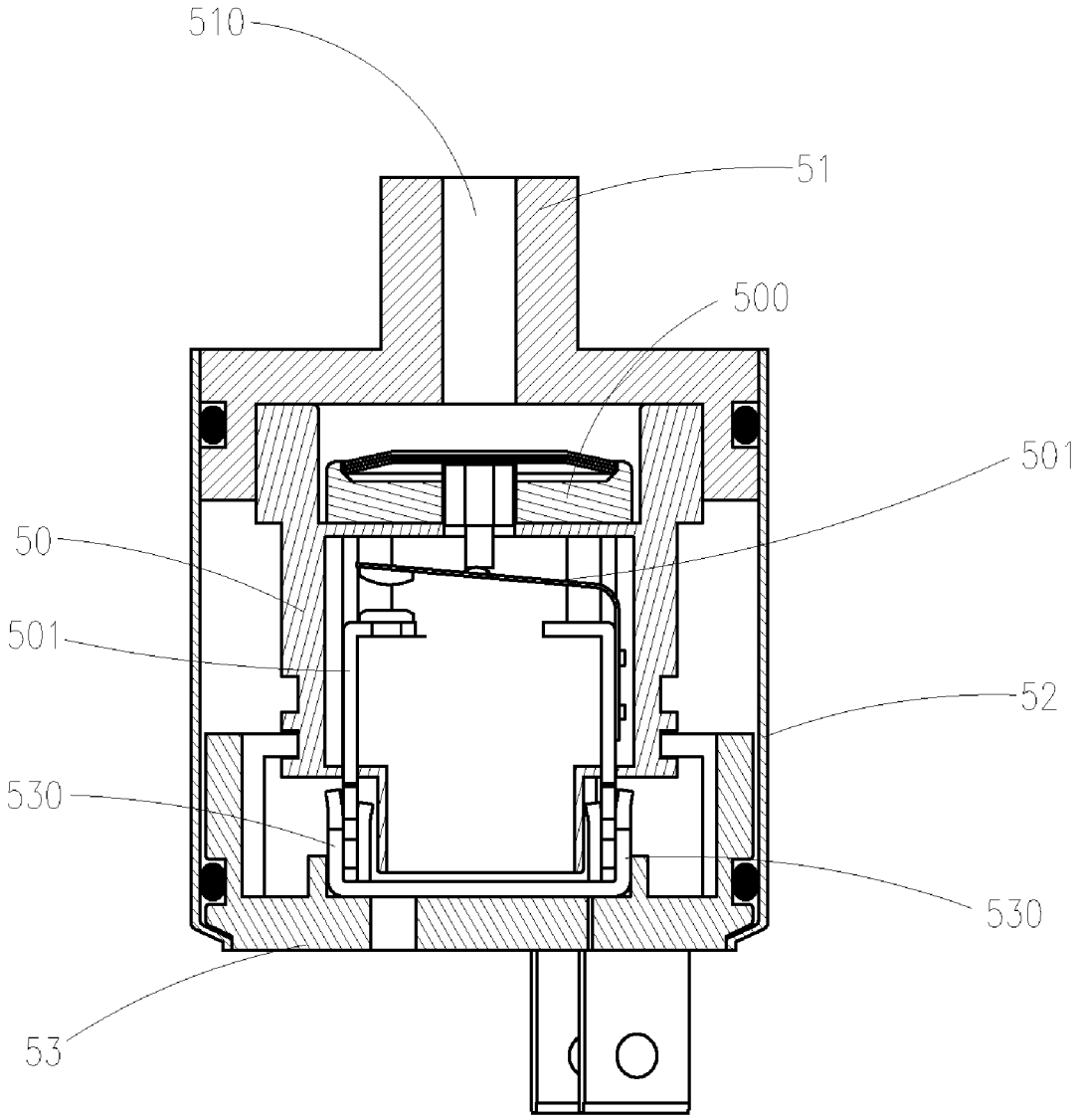
PRIOR ART FIG.10
FIG. 10 is a cross-sectional view of a conventional pressure switch in accordance with the prior art.

With reference to FIGS. 8 and 9 that respectively show a third and a fourth embodiments of the pressure switch in accordance with the present invention, the body (10) has a receiving space (11) defined therein and formed with a close end and an open end. Four passages (12) are respectively and longitudinally defined in a periphery of the receiving space (11), and a threaded hole (13) defined in the close end of the body (10) and communicating with the receiving space (11). A micro-adjust set (110) is received in the receiving space (11). Four passages (12) are respectively and longitudinally defined in a periphery of the receiving space (11) and a first lead (120), a second lead (121), a third lead (122) and a fourth lead (123) are respectively inserted into a corresponding one of the four passages (12) in the body (10). The lower cap (20) has four passages (22) longitudinally defined therein. A first prong (220), a second prong (221) a third prong (222) and a fourth prong (223) respectively extend through a corresponding one of the four passages (22) in the lower cap (20) and are electrically connected to the first lead (120), the second lead (121), the third lead (122) and the fourth lead (123) such that the pressure switch in accordance with the present invention can be suitable for different sockets and the use scope of the pressure switch in accordance with the present invention is widened.

Although the invention has been explained in relation to its preferred embodiment, it is to be understood that many other possible modifications and variations can be made without departing from the spirit and scope of the invention as hereinafter claimed.

What is claimed is:

1. A pressure switch comprising:

a body including a receiving space defined therein and formed with a close end and an open end, four passages respectively and longitudinally defined in a periphery of the receiving space, and a threaded hole defined in the close end of the body and communicating with the receiving space, a micro-adjust set received in the receiving space, the micro-adjust set including a cap urged toward the close end of the body and corresponding to the threaded hole, a resilient member, an adjust seat, an insulate stick and an insulator sequentially disposed on the cap, wherein the resilient member is compressively mounted between the cap and the adjust seat and the insulator is sleeved on the insulate stick, a first lead and a second lead respectively inserted into a corresponding one of the four passages, a bolt screwed through the threaded hole to abut against a bottom of the cap of the micro-adjust set;

a lower cap mounted to a lower end of the body, the lower cap having two passages longitudinally defined therein, a first prong and a second prong respectively extending through a corresponding one of the two passages in the lower cap and electrically connected to the first lead and the second lead;

an upper cap mounted to an upper end of the body, the upper cap including an inlet defined therein and extending therethrough, a free space defined in the upper cap for sequentially receiving a washer, a diaphragm, a first seat and a second seat, a first resilient film and a second resilient film respectively disposed in the first seat and the second seat, the diaphragm selectively closing the inlet, the insulator movably received in the second seat, the insulate stick sequentially extending through the second seat, the second resilient film and the first seat and abutting against the first resilient film; and a casing airtightly sleeved on an outer periphery of each of the lower cap and the upper cap.

2. The pressure switch as claimed in claim 1, wherein the upper cap includes a connector longitudinally extending therefrom for corresponding with different assemble ways.

3. The pressure switch as claimed in claim 1, wherein the body includes a third lead and a fourth lead respectively inserted into a corresponding one of the four passages in the body for preventing the micro-adjust set from a lateral movement when the micro-adjust set is longitudinally moved relative to the body.

4. A pressure switch comprising:

a body including a receiving space defined therein and formed with a close end and an open end, four passages respectively and longitudinally defined in a periphery of the receiving space, and a threaded hole defined in the close end of the body and communicating with the receiving space, a micro-adjust set received in the receiving space, the micro-adjust set including a cap urged toward the close end of the body and corresponding to the threaded hole, a resilient member, an adjust seat, an insulate stick and an insulator sequentially disposed on the cap, wherein the resilient member is compressively mounted between the cap and the adjust seat and the insulator is sleeved on the insulate stick, a first lead, a second lead, a third lead and a fourth lead respectively inserted into a corresponding one of the four passages, a bolt screwed through the threaded hole to abut against a bottom of the cap of the micro-adjust set;

a lower cap mounted to a lower end of the body, the lower cap having four passages longitudinally defined therein, a first prong, a second prong, a third prong and a fourth prong respectively extending through a corresponding one of the four passages in the lower cap and electrically connected to the first lead, the second lead, the third lead and the fourth lead;

an upper cap mounted to an upper end of the body, the upper cap including an inlet defined therein and extending therethrough, a free space defined in the upper cap for sequentially receiving a washer, a diaphragm, a first seat and a second seat, a first resilient film and a second resilient film respectively disposed in the first seat and the second seat, the diaphragm selectively closing the inlet, the insulator movably received in the second seat, the insulate stick sequentially extending through the second seat, the second resilient film and the first seat and abutting against the first resilient film; and a casing airtightly sleeved on an outer periphery of each of the lower cap and the upper cap.

5. The pressure switch as claimed in claim 4, wherein the upper cap includes a connector longitudinally extending therefrom for corresponding with different assemble ways.

* * * * *